US005275926A

United States Patent [19]

Hirabayashi et al.

[11] Patent Number: 5,275,926

[45] Date of Patent: Jan. 4, 1994

[54] SILVER HALIDE COLOR PHOTOGRAPHIC LIGHT-SENSITIVE MATERIAL

[75] Inventors: Shigeto Hirabayashi, Hachioji; Shuichi Sugita, Kunitachi; Katsumasa Yamazaki, Hachioji, all of Japan

[73] Assignee: Konica Corporation, Tokyo, Japan

[21] Appl. No.: 944,098

[22] Filed: Sep. 11, 1992

[30] Foreign Application Priority Data

Sep. 25, 1991 [JP] Japan ..... 3-273426

[51] Int. Cl.[5] ..... G03C 1/46

[52] U.S. Cl. ..... 430/505; 430/508; 430/372; 430/551; 430/555

[58] Field of Search ..... 430/508, 505, 372, 555, 430/551

[56] References Cited

U.S. PATENT DOCUMENTS

| | | | |
|---|---|---|---|
| 2,311,081 | 11/1941 | Porter et al. | 430/386 |
| 2,369,489 | 2/1945 | Porter et al. | 430/386 |
| 2,439,098 | 4/1948 | Porter et al. | 548/366.4 |
| 2,600,788 | 6/1952 | Loria et al. | 430/386 |
| 2,731,472 | 1/1956 | Reibnitz | 548/303.4 |
| 2,938,892 | 5/1960 | Sheehan | 530/354 |
| 2,950,197 | 8/1960 | Allen et al. | 430/625 |
| 2,964,404 | 12/1960 | Burness | 430/625 |
| 2,983,611 | 5/1961 | Allen et al. | 430/623 |
| 3,047,394 | 7/1962 | Allen et al. | 430/624 |
| 3,187,004 | 6/1965 | Siezak et al. | 548/303.4 |
| 3,226,234 | 12/1965 | Himmelmann et al. | 430/621 |
| 3,271,175 | 9/1966 | Burness et al. | 106/125 |
| 3,325,287 | 6/1967 | Yamamoto et al. | 430/543 |
| 3,396,029 | 8/1968 | Himmelmann et al. | 430/621 |
| 3,490,911 | 1/1970 | Burness et al. | 430/543 |
| 3,539,644 | 11/1970 | Burness et al. | 568/32 |
| 3,558,319 | 1/1971 | Hamaoka et al. | 430/554 |
| 3,623,878 | 11/1971 | Nishio et al. | 430/624 |
| 3,640,720 | 2/1972 | Cohen | 430/622 |
| 3,677,764 | 7/1972 | Glockner et al. | 430/449 |
| 3,832,181 | 8/1974 | Dallon et al. | 430/539 |
| 3,840,370 | 10/1974 | Dallon et al. | 430/537 |
| 4,043,818 | 8/1977 | Himmelmann et al. | 430/621 |
| 4,047,957 | 9/1977 | De Winter et al. | 430/451 |
| 4,061,499 | 12/1977 | Himmelmann | 430/422 |
| 4,894,318 | 1/1990 | Arakawa et al. | 430/372 |

FOREIGN PATENT DOCUMENTS

| | | |
|---|---|---|
| 0087984 | 9/1983 | European Pat. Off. . |
| 0348135 | 12/1989 | European Pat. Off. . |
| 0450965A1 | 9/1991 | European Pat. Off. . |
| 2336711 | 7/1977 | France . |
| 1552701 | 9/1979 | United Kingdom . |
| 2110832A | 7/1983 | United Kingdom . |

*Primary Examiner*—Charles L. Bowers, Jr.
*Assistant Examiner*—Geraldine Letscher
*Attorney, Agent, or Firm*—Finnegan, Henderson, Farabow, Garrett & Dunner

[57] ABSTRACT

There is provided a silver halide color photographic light-sensitive material which is improved in sensitivity, fog and resistance to formalin, and capable of providing photoprins of the same hue irrespective of the type of a printer employed. The color photographic material comprises photographic component layers including a blue-sensitive layer, a green-sensitive layer and a red-sensitive layer, wherein the green-sensitive layer contains a magenta coupler M-I and at least one of the component layers contains a formalin scavenger represented II through VI by the following formulas:

M-I

II (Abstract continued on next page.)

-continued
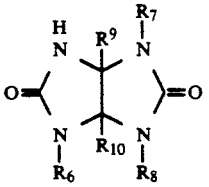
III
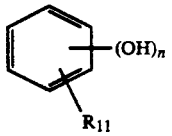
VI
-continued
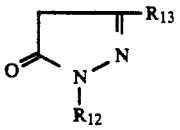
V
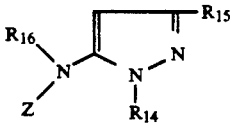
VI
10 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material, more specifically, to a silver halide color photographic light-sensitive material which is improved in sensitivity, resistance to fogging, and resistance to a harmful substance such as formaldehyde which may adversely affect photographic properties during storage, and also can provide photoprints of the same hue irrespective of the type of a printer employed.

BACKGROUND OF THE INVENTION

Nowadays, substractive three primary colors are employed for a silver halide color photographic light-sensitive material. A color image is formed by the combination of three dyes formed by a coupling reaction between couplers, i.e., a yellow coupler, a magenta coupler, a cyan coupler, and an oxidized p-phenylenediamine-based color developing agent.

As a magenta coupler for a silver halide color photographic light-sensitive material, pyrazolone, pyrazolinobenzimidazole, pyrazolonetriazole and indanone have heretofore been employed in the industry. Of them, 5-pyrazolone derivatives are the most common.

Examples of 5-pyrazolone derivatives include those obtained by introducing into the 3-position of 5-pyrazolone an alkyl group; aryl group; an alkoxy group (see U.S. Pat. No. 2,439,098); an acylamino group (see U.S. Pat. Nos. 2,369,489 and 2,600,788); and a ureido group (see U.S. Pat. No. 3,558,319).

These conventional magenta couplers, however, have a defect that does not allow a high-density magenta dye image to be obtained due to their low coupling activity. Further, a magenta dye produced from these couplers has an unfavorable secondary absorption in the blue light region, and its primary absorption is not sharp-cut in the longer wavelength region.

A 3-anilino-5-pyrazolone-based coupler described in U.S. Pat. No. 2,311,081, 3,677,764, British Patent Nos. 956,261 and 1,173,513 is improved in coupling activity and color development, and capable of providing a dye which has a very small secondary absorption in the red light region. However, this coupler has such a disadvantage that a dye formed therefrom has a primary absorption in a relatively short wavelength region, and, hence, a color negative film produced by using this coupler has poor color reproducibility.

Meanwhile, it has been revealed that, when a color negative is printed on color paper to obtain a photographic print, the hue of the photographic print tends to vary according to the type of printer employed. The hue of a magenta coupler contained in a negative is one of the factors contributing to this phenomenon.

It should be noted that such a variation in hue is most serious when a 3-anilino-5-pyrazolone-based coupler is employed as a magenta coupler.

Variation in photoprint hue caused by a change in the type of a printer can be suppressed to some extent by the use of a magenta coupler described in Japanese Patent Examined Publication No. 30615/1980.

However, studies by the inventors have revealed that this magenta coupler causes fogging, and makes the photographic properties of a light-sensitive material deteriorate during storage by the action of a harmful substance such as formaldehyde.

SUMMARY OF THE INVENTION

The object of the invention is to provide a silver halide color photographic light-sensitive material, more specifically, to provide a silver halide color photographic light-sensitive material which is improved in sensitivity, resistance to fogging, and resistance to a harmful substance such as formaldehyde which may adverselly affect photographic properties during storage, and can provide photoprints of the same hue irrespective of the type of a printer.

The above object can be attained by a silver halide color photographic light-sensitive material comprising a support, and provided thereon photographic component layers including blue-sensitive emulsion layers, green-sensitive emulsion layers and red-sensitive emulsion layers, wherein at least one of said green-sensitive emulsion layers contains at least one magenta coupler represented by formula M-I below, and at least one of said photographic component layers contains at least one formalin scavenger represented by any one of formulae II to VI:

Formula M-I

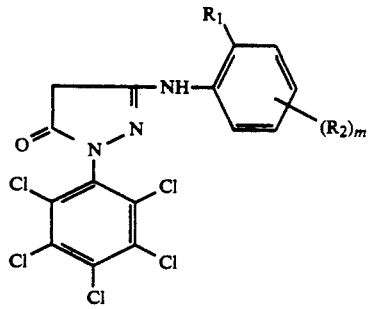

wherein $R_1$ represents a halogen atom or an alkoxy group; $R_2$ represents an acylamino group, a sulfonamide group, an imide group, a carbamoyl group, a sulfamoyl group, an alkoxycarbonyl group, an alkoxycarbonylamino group or an alkoxy group; and m represents an integer of 0 to 4.

Formula II

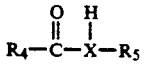

wherein $R_4$ represents a hydrogen atom, an alkyl group, an aryl group, an alkoxy group, an acylamino group or an amino group; $R_5$ represents a hydrogen atom, an alkyl group, an aryl group, an acyl group, an alkoxycarbonyl group, a carbamoyl group, an amino group or an amidino group, and may combine with $R_4$ to form a ring; and X represents >CH— or >N—.

Formula III

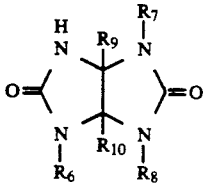

wherein $R_6$, $R_7$ and $R_8$ each represent a hydrogen atom, an alkyl group, an alkenyl group, an aralkyl group, an aryl group or an acyl group; and $R_9$ and $R_{10}$ each represent a hydrogen atom or an alkyl group.

Formula IV

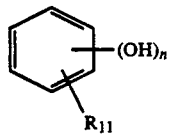

wherein $R_{11}$ represents a hydrogen aryl group, and may form a naphthalene ring with a phenyl ring; and n represents an integer of 2 or more.

Formula V

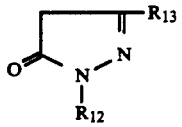

wherein $R_{12}$ represents a hydrogen atom or a substituent; and $R_{13}$ represents a hydrogen atom or a substituent.

Formula VI

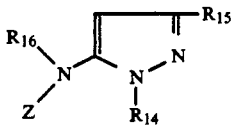

wherein $R_{14}$ and $R_{15}$ each represent a hydrogen atom or a substituent; $R_{16}$ represents a hydrogen atom or an alkyl group; Z represents a hydrogen atom, an alkyl group, an aryl group, $—SO_2R_{17}$ or

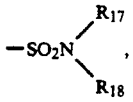

and may combine with $R_{16}$ to form a ring; $R_{17}$ represents an alkyl group, an aryl group or a heterocyclic group; and $R_{18}$ has the same meaning as $R_{16}$.

The present invention will be described in detail.

First, explanation will be made on formula M—I. The halogen atom represented by $R_1$ may be a chlorine atom, a bromine atom or a fluorine atom. The alkoxy group represented by $R_1$ may be a methoxy group or a dodecyloxy group. A chlorine atom is preferable as $R_1$.

The acylamino group represented by $R_2$ may be 2,4-di-t-pentylphenoxyacetamide group or 4-(2,4-di-t-pentylphenoxy)butanamide. The sulfonamide group represented by $R_2$ may be 4-dodecyloxyphenylsulfonamide group. The imide group represented by R2 may be octadecenylsuccinimide. The carbamoyl group represented by $R_2$ may be 4-(2,4-di-t-pentylphenoxy)-butylaminocarbonyl group. The sulfamoyl group represented by $R_2$ may be tetradecanesulfamoyl group. The alkoxycarbonyl group represented by $R_2$ may be tetradecaneoxycarbonyl group. The alkoxycarbonylamino group represented by $R_2$ may be dodecyloxycarbonylamino group. The alkoxy group represented by $R_2$ may be a methoxy group, an ethoxy group or an octyloxy group. As $R_2$, an acylamino group is preferable which is substituted at the p-position relative to $R_1$. It is preferred that m be 1.

Specific examples of compounds represented by formula M-I (hereinafter referred to as magenta coupler M-I) are given below. However, the scope of the invention is not limited to these examples.

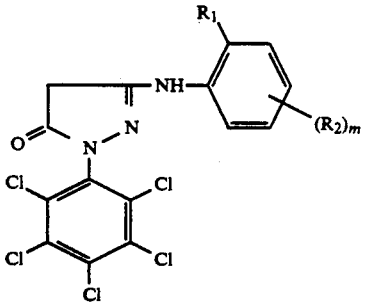

| Compounds | $R_1$ | $(R_2)_m$ |
|---|---|---|
| M-1 | Cl | 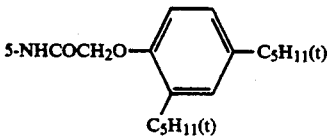 |
| M-2 | Cl | 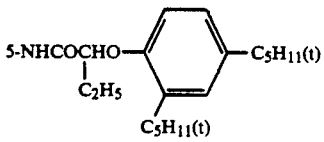 |

-continued
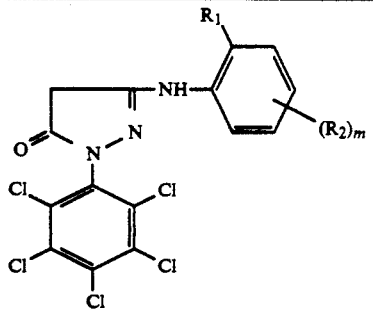
| Compounds | $R_1$ | $(R_2)_m$ |
|---|---|---|
| M-3 | Cl | 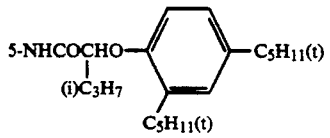 |
| M-4 | Cl | 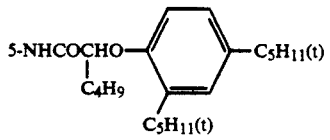 |
| M-5 | Cl | 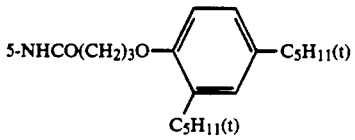 |
| M-6 | Cl | 5-$NHSO_2C_{16}H_{33}$ |
| M-7 | Cl | 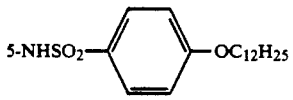 |
| M-8 | $OCH_3$ | 5-$NHSO_2C_{12}H_{25}$ |
| M-9 | Cl | 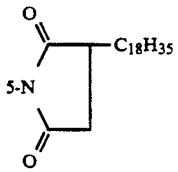 |
| M-10 | Cl | 5-$NHCOC_{13}H_{27}$ |
| M-11 | $OCH_3$ | 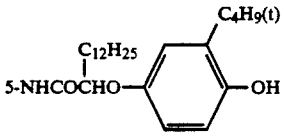 |
| M-12 | Cl | 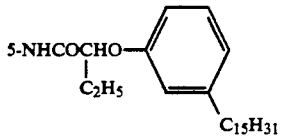 |
| M-13 | Cl | 5-$CONHC_{12}H_{25}$ |
| M-14 | Cl | 5-$SO_2N(C_8H_{17})_2$ |
| M-15 | Cl | 4-$OC_8H_{17}$, 5-$OC_8H_{17}$ |
| M-16 | Cl | 5-$COOC_{12}H_{25}$ |

-continued

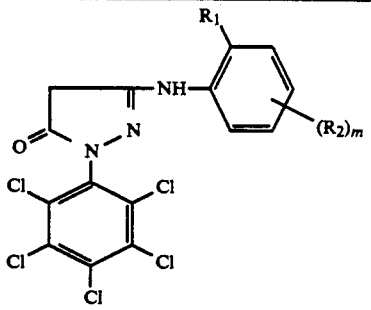

| Compounds | $R_1$ | $(R_2)_m$ |
|---|---|---|
| M-17 | Cl | 5-NHCO(CH$_3$)CHCH$_2$SO$_2$C$_{12}$H$_{25}$ |
| M-18 | Cl | 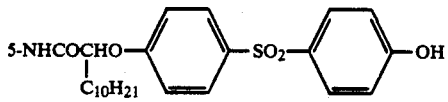 |
| M-19 | Cl | 5-NHCOOC$_{12}$H$_{25}$ |
| M-20 | Cl | 5-OC$_{12}$H$_{25}$ |

These magenta couplers can be synthesized by the method described in Japanese Patent Publication Open to Public Inspection (hereinafter referred to as Japanese Patent O.P.I. Publication) No. 80027/1977.

An example of synthesis of magenta coupler M-I is given below.

Synthesis of Example Compound M-5

To 75 ml of ethyl acetate, 11.2 g of 1-pentachlorophenyl-3-(2-chloro-5-aminoanilino)-5-pyrazolone was added. Then, 20 ml of an aqueous solution of 2.7 g of sodium acetate was added, followed by one-hour stirring at room temperature. Further, 25 ml of an ethyl acetate solution of 9.2 g of 4-(2,4-di-t-pentylphenoxy)-butanoyl chloride was added for 10 minutes. After 3-hour stirring at room temperature, an aqueous phase was removed, and washed with 50 ml of water. Ethyl acetate was removed by vacuum distillation, and the residue was recrystallized with toluene, whereby 12.8 g of an intended product was obtained (white crystals with a melting point of 125° C. to 127° C.). This product was identified as magenta coupler M-5 by Mass, NMR and IR spectroscopy.

Magenta coupler M-I of the present invention is employed normally in an amount of $1\times10^{-3}$ to 1 mol, preferably $1\times10^{2}$ to $8\times10^{-1}$ mol, per mol silver halide.

Magenta coupler M-I can be employed in combination with other magenta couplers, such as 5-pyrazolone-based couplers, pyrazoloazole-based couplers, pyrazolobenzimidazole-based couplers, open-ring acylacetonitrile-based couplers and indazole-based couplers.

An explanation will be made on a formalin scavenger represented by any one of formulae II to VI.

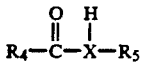

Formula II

-continued

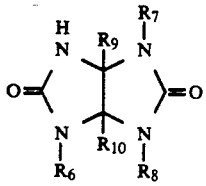

Formula III

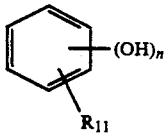

Formula IV

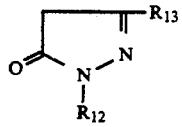

Formula V

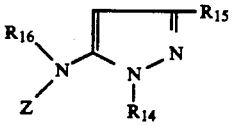

Formula VI

In formula II, $R_4$ represents a hydrogen atom, an alkyl group, an aryl group, an alkoxy group, an acylamino group or an amino group. $R_5$ represents a hydrogen atom, an alkyl group, an aryl group, an acyl group, an alkoxycarbonyl group, a carbamoyl group, an amino group or an amidino group. $R_4$ and $R_5$ may combine with each other to form a ring. $R_4$ and $R_5$ each may have a substituent such as a hydroxyl group, a carboxyl group, an amino group, an ureido group, a nitro group and a halogen atom. X represents >CH— or >N—.

In formula III, $R_6$, $R_7$ and $R_8$, whether identical or not, each represent a hydrogen atom, an alkyl group (e.g. methyl, ethyl, propyl, i-propyl, butyl, hydroxymethyl, 2-hydroxyethyl, methoxymethyl, chloromethyl, carboxymethyl, cyanoethyl), an alkenyl group (e.g. allyl, 2-butenyl, 2-chloroallyl), an aralkyl group (e.g. benzyl, phenetyl, p-methoxybenzyl), an aryl group (e.g. phenyl, p-tolyl, p-methoxyphenyl, o-chlorophenyl, m-hydroxyphenyl), or an acyl group (e.g. aceyyl, propionyl, trifluoroacetyl, chloroacetyl, acryloyl, methacryloyl).

$R_9$ and $R_{10}$ each represent a hydrogen atom or an alkyl group (e.g. the same alkyl group as that represented by $R_6$, $R_7$ or $R_8$).

Compounds represented by formula III include high-molecular compounds formed by the linkage of a compound of formula III to a high-molecular chain (e.g. a polyethylene chain, a polypropylene chain) through a group represented by $R_6$, $R_7$ or $R_8$. In this case, as a binding group, —CO—, —COO— or —CONH— may be used.

In formula IV, $R_{11}$ represents a hydrogen atom, an alkyl group or an aryl group. $R_{11}$ may form a naphthalene ring with a phenyl ring. An alkyl group or aryl group represented by $R_{11}$ may have a substituent. n represents an integer of 2 to 4.

In formula V, $R_{12}$ represents a hydrogen atom or a substituent. Examples of usable substituents include an alkyl group, an aryl group, a cycloalkyl group, an acyl group, a carbamoyl group, a sulfamoyl group and an alkoxycarbonyl group. These groups each may have a substituent such as a carboxyl group, a sulfo group, a hydroxyl group and an amino group.

$R_{13}$ represents a hydrogen atom or a substituent. Examples of usable substituents include an alkyl group, an aryl group, a cyano group, a carbamoyl group, a carboxyl group, an alkoxycarbonyl group, an acyl group, a haloalkyl group, a nitro group, a sulfamoyl group, an alkylsulfamoyl group and an alkylsulfonyl group.

In formula VI, $R_{14}$ and $R_{15}$ each represent a hydrogen atom or a substituent. $R_{16}$ represents a hydrogen atom or an alkyl group. Z represents a hydrogen atom, an alkyl group, an aryl group, $—SO_2R_{17}$ or

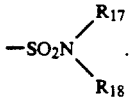

$R_{17}$ represents an alkyl group, an aryl group or a heterocyclic group. $R_{18}$ has the same meaning as $R_{16}$ $R_{16}$ and Z may Combine with each other to form a ring.

Examples of a substituent represented by $R_{14}$ include a straight-chain or branched alkyl group having 1 to 18 carbon atoms (e.g. methyl, ethyl, dodecyl), a cycloalkyl group having 5 to 7 carbon atoms (e.g. cyclopentyl, cyclohexyl), an aryl group (e.g. phenyl, naphthyl), a 5- or 6-membered heterocyclic group (e.g. pyridyl, pyrimidyl, pyrrolyl, pyrazolyl, imidazolyl, triazolyl, furyl, thienyl, thiazolyl, piperidino),

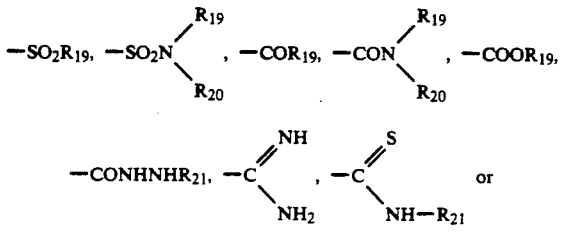

-continued

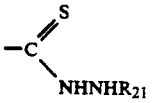

wherein $R_{19}$ represents an alkyl group, an aryl group or a heterocyclic group; $R_{20}$ represents a hydrogen atom or an alkyl group; and $R_{21}$ represents a hydrogen atom, an alkyl group, an aryl group or a heterocyclic group.

These substituents each may have a substituent, such as an alkyl group, an alkoxy group, an acylamino group, a sulfonamide group, a carbamoyl group, a sulfamoyl group, an alkoxycarbonyl group, a nitro group, a cyano group, a hydroxyl group, a carboxyl group, a sulfo group or a halogen atom. Of them, a sulfo group, a carboxyl group and a hydroxyl group are preferable.

As $R_{14}$, a hydrogen atom, an alkyl group, an aryl group, an alkylsulfonyl group, an acyl group, a carbamoyl group and an alkoxycarbonyl group are preferable.

Examples of a substituent represented by $R_{15}$ include a $C_{1-18}$ straight-chain or branched alkyl having 1 to 18 carbon atoms (e.g. methyl, ethyl, undecyl), a cycloalkyl group having 5 to 7 carbon atoms (e.g. cyclopentyl, cyclohexyl), an aryl group (e.g. phenyl, naphthyl), an alkoxy group (e.g. methoxy, ethoxy), an aryloxy group (e.g. phenoxy group), an alkoxycarbonyl group (e.g. methoxycarbonyl, ethoxycarbonyl), an aryloxycarbonyl group (e.g. phenoxycarbonyl), a carbamoyl group (e.g. dimethylcarbamoyl, diethylcarbamoyl), an acyl group (e.g. acetyl, benzoyl), an amino group, an alkylamino group (e.g. methylamino, dimethylamino), an arylamino group (e.g. anilino), an acylamino group (e.g. acetylamino, benzamido), a sulfonamide group (e.g. methanesulfonamide, benzenesulfonamide), a carbamoylamino group (e.g. dimethylcarbamoylamino), a sulfamoylamino group (e.g. dimethylsulfamoylamino), an alkoxycarbonylamino group (e.g. methoxycarbonylamino, ethoxycarbonylamino), a cyclic amino group (e.g. morpholino, piperidino, pyrrolidino), a carboxyl group and a cyano group.

These substituents each may have a substituent. Suitable substituents are those listed as substituents for $R_{14}$. As $R_{15}$, a hydrogen atom, an alkyl group, an alkoxy group, an alkoxycarbonyl group, a carboxyl group, an acylamino group, a carbamoylamino group, a sulfonamide group, a sulfamoylamino group and an alkoxycarbonylamino group are preferable. Of them, an alkyl group, an acylamino group, a carbamoylamino group, a sulfonamide group and an alkoxycarbonylamino group are especially preferable.

An alkyl group represented by $R_{16}$ may be a straight-chain or branched alkyl group having 1 to 18 carbon atoms, which may be substituted with a halogen atom, an alkoxy group, an aryloxy group, an acylamino group, a sulfonamide group, a carbamoyl group, a sulfamoyl group, an alkoxycarbonyl group, a nitro group, a cyano group, a hydroxyl group, a carboxyl group, a sulfo group, an amino group, an alkylamino group or a dialkylamino group.

Z represents a hydrogen atom, an alkyl group, an aryl group $—SO_2R_{17}$ or

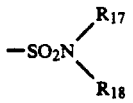

(wherein $R_{17}$ represents an alkyl group, an aryl group or a heterocyclic group; and $R_{18}$ has the same meaning as $R_{16}$) Specific examples include a methyl group, an ethyl group, a butyl group, a methoxymethyl group, a cyanoethyl group, a phenyl group, a methylsulfonyl group, an ethylsulfonyl group, a butylsulfonyl group, a benzenesulfonyl group, a dimethylsulfamoyl group and a diethylsulfamoyl group. An alkyl group and an alkylsulfonyl group are preferable as Z.

Representative examples of a compound represented by any one of formula II to VI are given below. However, the scope of the invention is not limited to these examples.

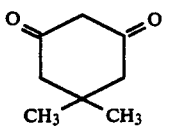

II-1

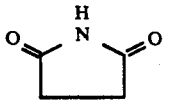

II-2

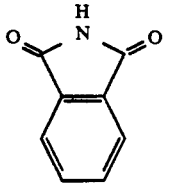

II-3

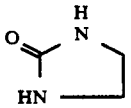

II-4

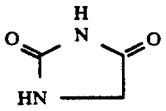

II-5

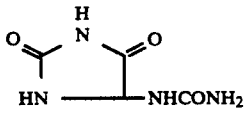

II-6

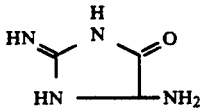

II-7

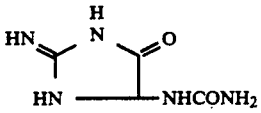

II-8

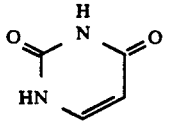

II-9

-continued

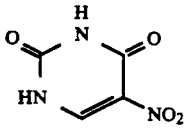

II-10

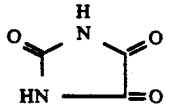

II-11

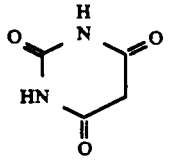

II-12

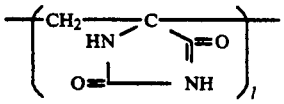

II-13

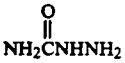

II-14

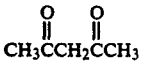

II-15

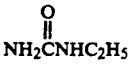

II-16

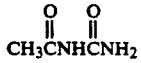

II-17

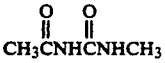

II-18

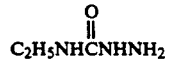

II-19

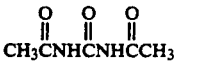

II-20

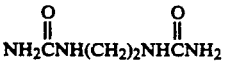

II-21

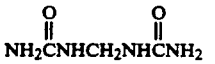

II-22

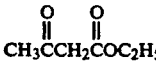

II-23

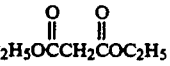

II-24

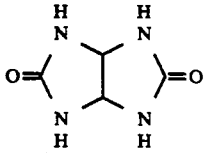

III-1

-continued
III-2
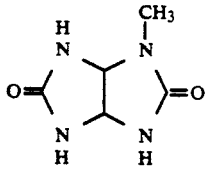
III-3
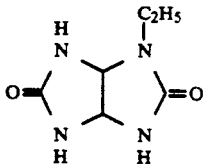
III-4
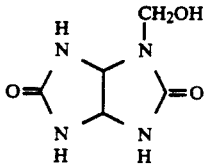
III-5
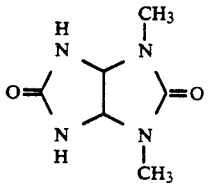
III-6
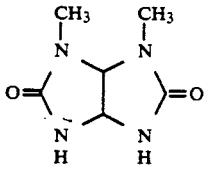
III-7
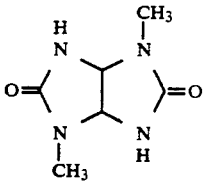
III-8
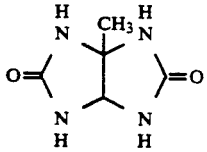
III-9
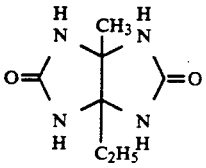
-continued
III-10
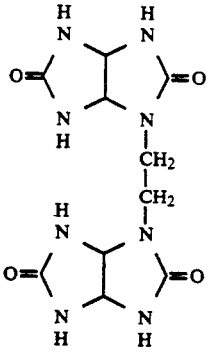
III-11
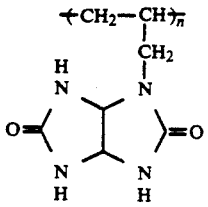
IV-1
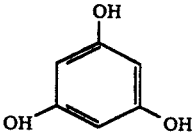
IV-2
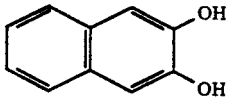
IV-3
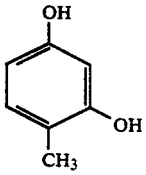
V-1
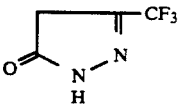
V-2
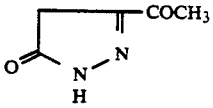
V-3
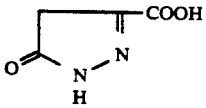
V-4
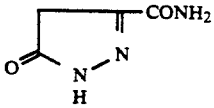
V-5
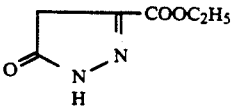

-continued
V-6
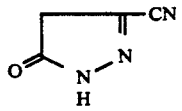
V-7
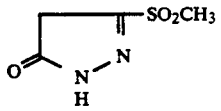
V-8
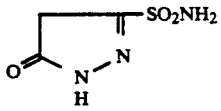
V-9
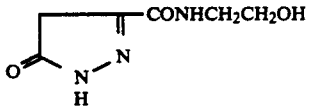
V-10
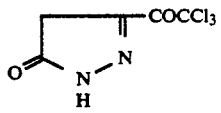
V-11
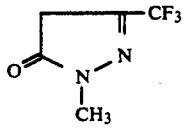
V-12
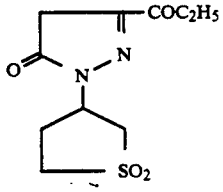
V-13
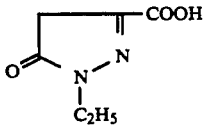
V-14
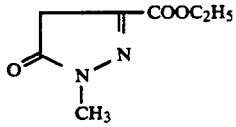
V-15
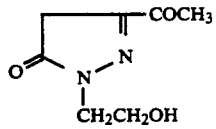
V-16
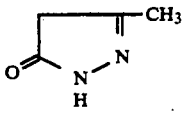
V-17
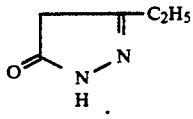
-continued
V-18
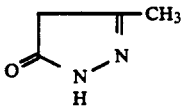
V-19
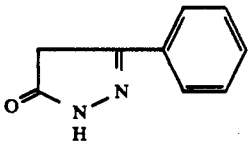
V-20
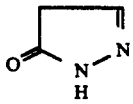
V-21
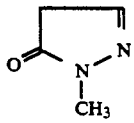
V-22
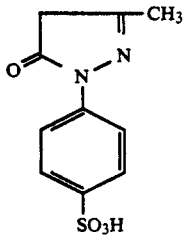
V-23
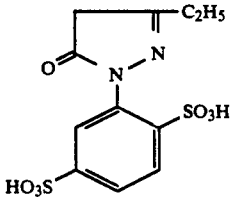
V-24
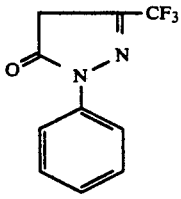
V-25
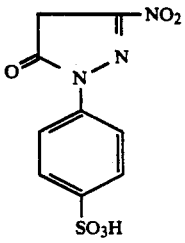

-continued
V-26
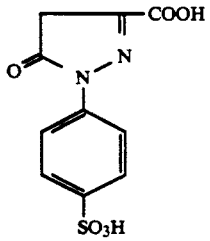
V-27
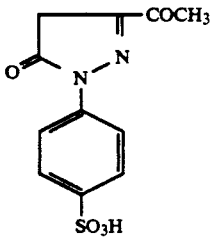
V-28
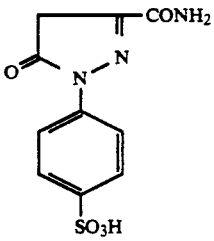
V-29
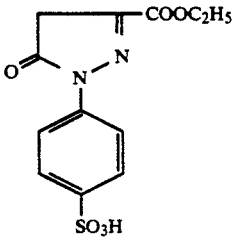
V-30
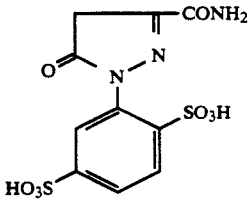
V-31
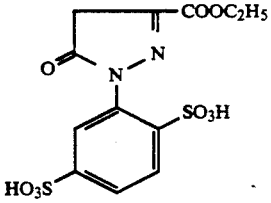
V-32
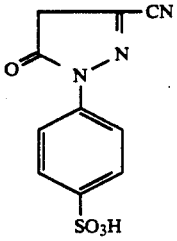
-continued
V-33
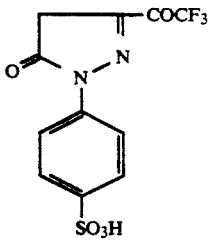
V-34
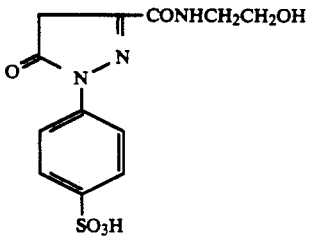
V-35
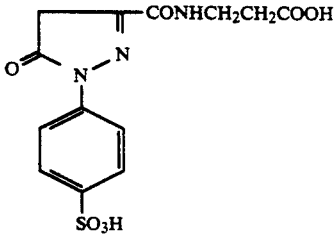
V-36
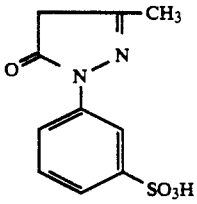
V-37
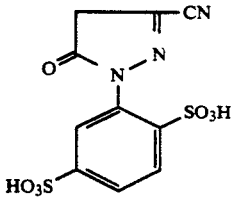
V-38
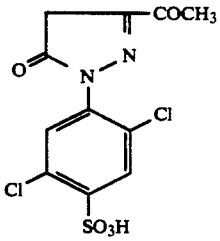
V-39
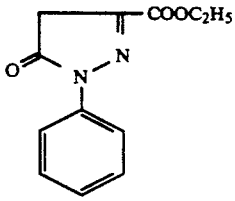

-continued
V-40
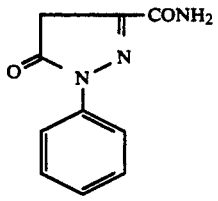
VI-1
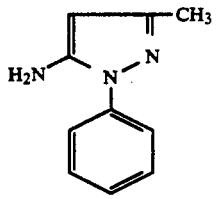
VI-2
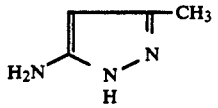
VI-3
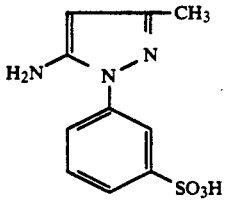
VI-4
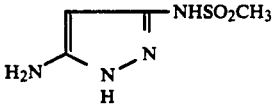
VI-5
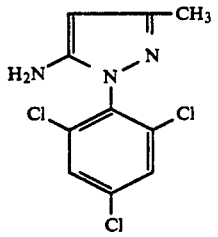
VI-6
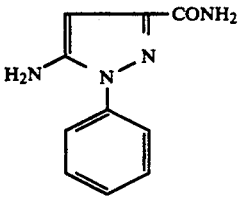
VI-7
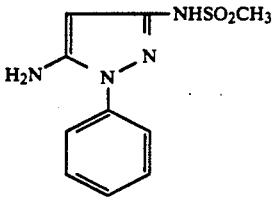
-continued
VI-8
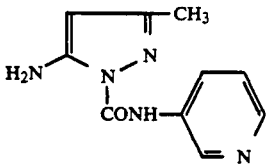
VI-9
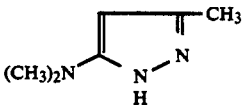
VI-10
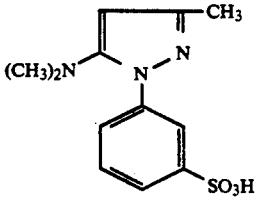
VI-11
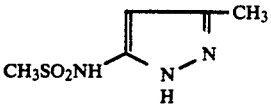
VI-12
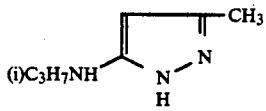
VI-13
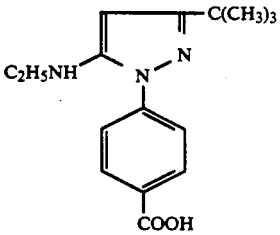
VI-14
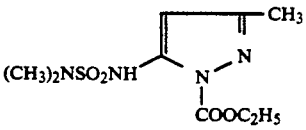
VI-15
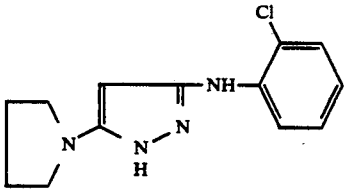
VI-16
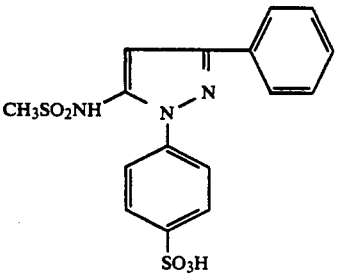

-continued

VI-17

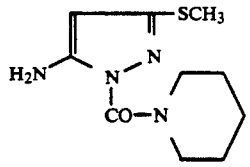

VI-18

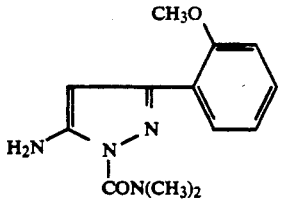

VI-19

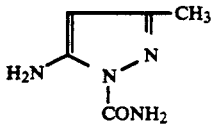

VI-20

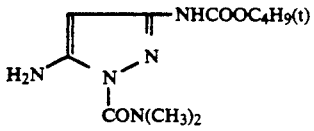

VI-21

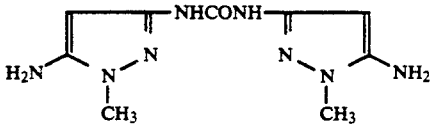

VI-22

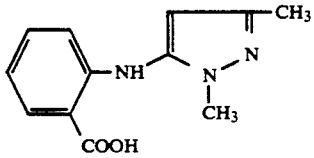

VI-23

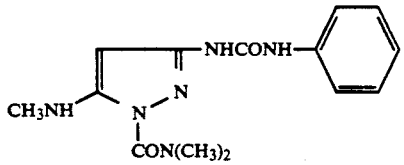

VI-24

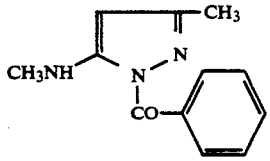

Most of the above compounds are commercially available, and those which are not commercially available can be synthesized easily according to conventional methods.

For instance, compounds II-7 and II-8 can be prepared by methods described in Bulletin of the Chemical Society of Japan, Vol. 39, pp. 1559–1567 and 1734–1738 (1966), Chemische der Berichte, Vol. 54, B, pp. 1802–1833 and 2441–2479 (1921) and Beilstein Handbuch der Organischen Chemie, H, p. 98 (1921).

Compound II-13 is an oligomer or polymer with one repeating unit. 1 is an integer of 2 or more.

Compound II-19 can be prepared by methods described in Beilstein Handbuch der Organischen Chemie, 1st revised ed. Vol. 4, p. 354 and Vol. 3, p. 63.

Compounds III-1 and III-11 can be prepared by methods described in British Patent No. 717,287, U.S. Pat. Nos. 2,731,472 and 3,187,004, H. Pauly, Chemische de Berichte, 63B, p. 2063 (1930), F. B. Slezak, Journal of Organic Chemistry, 27, p. 2181 (1962), J. Nematollahl, Journal of Organic Chemistry, 28, p. 2378 (1963). By subjecting glycol uryl to alkylation, acylation, hydroxymethylation, alkoxymethylation and halomethylation in the usual way, an alkyl derivative, an acyl derivative, a hydroxymethyl derivative, an alkoxymethyl derivative and a halomethyl derivative can be obtained, respectively.

Compounds V-1 to V-30 can be prepared by methods described in Japanese Patent O.P.I. Publication Nos. 7327/1976 and 273527/1987 and British Patent No. 585,780.

Compounds VI-1 to VI-24 can be prepared by methods described in Berichte der Deutschen Chemischen Gesellschaft, Vol. 57, p. 332 (1924), Annalen der Chemie, Vol. 52, p. 662 (1936), Vol. 397, p. 119 (1913), Vol. 568, p. 227 (1950), Journal of the American Chemical Society, Vol. 734, p. 664 (1951).

In the case of a light-sensitive material in which photographic component layers are superimposed on a magenta coupler-containing layer, a formalin scavenger according to the invention can be contained, either alone or in combination, in the magenta coupler-containing layer and/or at least one of the photographic component layers provided outer (or farther) than the magenta coupler-containing layer from a support. A conventional formalin scavenger can be employed in combination. Most desirably, formalin scavengers should be contained in the outermost layer, e.g. a protective layer.

The "photographic component layers" as referred to herein mean layers that constitute a light-sensitive material, including spectrally or chemically sensitized silver halide emulsion layers and non-light-sensitive auxiliary layers such as an intermediate layer, a UV absorbing layer, a yellow filter layer and a protective layer.

A formalin scavenger according to the invention can be contained in an intended layer by a method in which a formalin scavenger is dissolved in a suitable solvent (e.g. water, methanol), and the resulting solution is added to a coating liquid to be used for forming the intended layer. The timing of the addition is not limitative. In the case of a silver halide emulsion, a formalin scavenger may be added thereto at any point of time during the preparation of the emulsion, but preferably, should be added immediately before coating.

A formalin scavenger of the invention should be employed preferably in an amount of 0.01 to 5.0 g, still preferably 0.1 to 2.0 g, per square meter of a color photographic light-sensitive material.

As a silver halide, use can be made of any of silver halides which have been employed in the photographic industry, such as silver bromide, silver iodobromide, silver iodochloride, silver chlorobromide and silver chloride.

A silver halide grain may or may not have a uniform halide composition from its inside to surface.

A latent image may be formed either on the surface or in the inside of a silver halide grain.

The size distribution of silver halide grains is not limitative; use can be made of polydispersed grains, monodispersed grains or a mixture of polydispersed grains and monodispersed grains.

It is possible to use two or more silver halide emulsions that have been prepared separately.

Silver halide grains used in the present invention may be chemically sensitized by the sulfur sensitization method, the selenium sensitization method, the reduction sensitization method or the noble metal sensitization method.

Silver halide grains to be used in the invention may be spectrally sensitized to a desired wavelength region with a conventional sensitizing dye.

An anti-fogging agent, a stabilizer and other additives may be added to a silver halide emulsion.

As a binder (or a protective colloid) to be employed for an emulsion or the like, gelatin is most advantageous. Also usable are a gelatin derivative, a graft polymer of gelatin and other high-molecular substances, protein, a sugar derivative, a cellulose derivative and a synthetic hydrophilic polymer such as a homo- or copolymer.

A hardener may be added to photographic component layers and other hydrophilic colloidal layers. A hardener serves to allow the molecules of a binder (or a protective colloid) contained therein to be cross-linked, thereby increasing the film strength. Two or more hardeners may be used in combination.

Usable hardeners include aldehyde hardeners, aziridine hardeners (see PB report No. 19,921, U.S. Pat. Nos. 2,950,197, 2,964,404, 2,983,611, 3,271,175, Japanese Patent Examined Publication No. 40898/1971, Japanese Patent O.P.I. Publication No. 91315/1975), epoxy hardeners (see U.S. Pat. No. 3,047,394, West German Patent No. 1,085,663, British Patent No. 1,033,518, Japanese Patent Examined Publication No. 35495/1973), vinylsulfone hardeners (see PB report No. 19,920, German Patent Nos. 1,100,942, 2,337,412, 2,545,722, 2,635,518, 2,742,308, 2,749,260, British Patent No. 1,251,091, Japanese Patent Application Nos. 54236/1970, 110996/1973, U.S. Pat. Nos. 3,539,644, 3,490,911), acryloyl hardeners (see Japanese Patent Application Nos. 27949/1973, U.S. Pat. No. 3,640,720), carboxyl activated hardeners (see WO-2357, U.S. Pat. Nos. 2,938,892, 3,331,609, 4,043,818, 4,061,499, Japanese Patent Examined Publication Nos. 38715/1971, 38655/1980, 32699/1983, Japanese Patent O.P.I. Publication Nos. 155346/1980, 110762/1981, 225148/1985, 100743/1986, 264044/1987), triazine hardeners (see West German Patent No. 2,410,973, 2,553,915, U.S. Pat. No. 3,325,287, Japanese Patent O.P.I. Publication No. 12722/1977), high-molecular hardeners (see British Patent No. 822,061, U.S. Pat. Nos. 3,623,878, 3,396,029, 3,226,234, Japanese Patent Examined Publication Nos. 18578/1972, 18579/1972, 48896/1972), maleimide hardeners, acetylene hardeners, methanesulfonate hardeners and N-methylol hardeners. These hardeners may be employed either alone or in combination. For the combined use of two or more hardeners, it is advisable to employ the manner of combination described in West German Patent Nos. 2,447,587, 2,505,746, 2,514,245, U.S. Pat. Nos. 4,047,957, 3,832,181, 3,840,370, Japanese Patent O.P.I. Publication Nos. 43319/1973, 63062/1975, 127329/1977 or Japanese Patent Examined Publication No. 32364/1973.

Of them, hydrophilic vinylsulfone compounds described in U.S. Pat. No. 3,539,644, Japanese Patent O.P.I. Publication Nos. 74832/1973, 24435/1974, 21059/1977, 77076/1977, 41221/1978, 57257/1978 and 241539/1988 are preferable in respect of storage stability.

A silver halide emulsion may contain a plasticizer and a latex of a polymer which is insoluble or sparingly soluble in water.

A silver halide light-sensitive material of the invention may contain couplers other than a magenta coupler of the invention. Usable couplers include yellow couplers, cyan couplers, competitive couplers for color compensation, and compounds capable of releasing, upon a coupling reaction with an oxidized color developing agent, photographically effective fragments including development accelerators, bleaching accelerators, developing agents, silver halide solvents, toning agents, hardeners, fogging agents, anti-foggants, chemical sensitizers, spectral sensitizers and desensitizers.

Conventional acylacetoanilide-based compounds are usable as a yellow coupler. In particular, benzoylacetoanilide-based compounds and pivaloylacetoanilide-based compounds are useful. Phenol-based compounds and naphthol-based compounds are employable as a cyan coupler.

Couplers are added to a light-sensitive material by a known method; a coupler is dissolved in a high-boiling solvent (optionally, in a mixture of a high-boiling solvent and a low-boiling solvent), and then finely dispersed in a dispersion medium. The resulting dispersion is added to a silver halide emulsion. If need arises, a hydroquinone derivative, a UV absorber and an anti-fading agent may be added to an emulsion together with a coupler dispersion.

A silver halide light-sensitive material of the invention may be provided with auxiliary layers such as a filter layer, an anti-halation layer and an anti-irradiation layer. These layers and/or emulsion layers each may contain a dye which will be released from a light-sensitive material or bleached during development.

A silver halide light-sensitive material of the invention may contain such additives as a matting agent, a lubricant, an image stabilizer, a UV absorber, a fluorescent brightener, a surfactant, a development accelerator, a development retarder and a bleaching accelerator.

Photographic emulsion layers and other layers are provided on a variety of supports; a paper support coated with baryta or a polymer of an $\alpha$-olefin (the $\alpha$-olefin polymer layer may be one which can be readily removed); synthetic paper support (flexible, reflective support); a reflective support made of a semi-synthesized or synthesized polymer (e.g. cellulose acetate, cellulose nitrate, polystyrene, polyvinyl chloride, polyethylene terephthalate, polycrbonate, polyamide) or one coated with a white pigment; and a rigid support made of glass, metal or ceramics. A thin, reflective support with such a reduced thickness as 120 to 160 $\mu$m is also usable.

To obtain a dye image, a silver halide light-sensitive material of the invention containing couplers is subjected to color development in the usual way after exposure.

Immediately after color development, a light-sensitive material is treated with a bleacher and a fixer. A bleach-fixer may be used instead of a bleacher and a fixer. As a bleaching agent, a metal complex salt of an organic salt is normally used.

Normally, fixing is followed by rinsing. Stabilizing may be conducted in place of rinsing. It is also possible to perform both stabilizing and rinsing.

EXAMPLES

The present invention will be described in more detail according to the following examples, which should not be construed as limiting the scope of the invention.

Example 1

On a cellulose triacetate film support, layers with the following compositions were provided in sequence from the support to obtain a multilayer color photographic light-sensitive material (Sample No. 1).

Unless otherwise indicated, the amounts of ingredients were each expressed in terms of gram per square meter of a light-sensitive material. The amounts of silver halides and colloidal silver were each translated into the amount of silver contained therein. The amounts of sensitizing dyes were each indicated in terms of mol per mol silver.

| | |
|---|---|
| First layer: Anti-halation layer (HC) | |
| Black colloidal silver | 0.15 |
| UV absorber (UV-1) | 0.20 |
| Colored cyan coupler (CC-1) | 0.02 |
| High boiling solvent (Oil-1) | 0.20 |
| High-boiling solvent (Oil-2) | 0.20 |
| Gelatin | 1.6 |
| Second layer: Intermediate layer (IL-1) | |
| Gelatin | 1.3 |
| Third layer: Low-speed red-sensitive emulsion layer (RL) | |
| Silver iodobromide emulsion (Em-1) | 0.4 |
| Silver iodobromide emulsion (Em-2) | 0.3 |
| Sensitizing dye (S-1) | $3.2 \times 10^{-4}$ |
| Sensitizing dye (S-2) | $3.2 \times 10^{-4}$ |
| Sensitizing dye (S-3) | $0.2 \times 10^{-4}$ |
| Cyan coupler (C-1) | 0.50 |
| Cyan coupler (C-2) | 0.13 |
| Colored cyan coupler (CC-1) | 0.07 |
| DIR compound (D-1) | 0.01 |
| High-boiling solvent (Oil-1) | 0.55 |
| Gelatin | 1.0 |
| Fourth Layer: High-speed red-sensitive emulsion layer (RH) | |
| Silver iodobromide emulsion (Em-3) | 0.9 |
| Sensitizing dye (S-1) | $1.7 \times 10^{-4}$ |
| Sensitizing dye (S-2) | $1.6 \times 10^{-4}$ |
| Sensitizing dye (S-3) | $0.1 \times 10^{-4}$ |
| Cyan coupler (C-2) | 0.23 |
| Colored cyan coupler (CC-1) | 0.03 |
| DIR compound (D-1) | 0.02 |
| High boiling solvent (Oil-1) | 0.25 |
| Gelatin | 1.0 |
| Fifth layer: Intermediate layer (IL-2) | |
| Gelatin | 0.8 |
| Sixth layer: Low-speed green-sensitive emulsion layer (GL) | |
| Silver iodobromide emulsion (Em-1) | 0.6 |
| Silver iodobromide emulsion (Em-2) | 0.2 |
| Sensitizing dye (S-4) | $6.7 \times 10^{-4}$ |
| Sensitizing dye (S-5) | $0.8 \times 0^{-4}$ |
| Magenta coupler (M-A) | 0.47 |
| Colored magenta coupler (CM-1) | 0.10 |
| DIR compound (D-3) | 0.02 |
| High-boiling solvent (Oil-2) | 0.70 |
| Gelatin | 1.0 |

-continued

| | |
|---|---|
| Seventh layer: High-speed green-sensitive emulsion layer (GH) | |
| Silver iodobromide emulsion (Em-3) | 0.9 |
| Sensitizing dye (S-6) | $1.1 \times 10^{-4}$ |
| Sensitizing dye (S-7) | $2.0 \times 10^{-4}$ |
| Sensitizing dye (S-8) | $0.3 \times 10^{-4}$ |
| Magenta coupler (M-A) | 0.15 |
| Colored magenta coupler (CM-1) | 0.04 |
| DIR compound (D-3) | 0.04 |
| High-boiling solvent (Oil-2) | 0.35 |
| Gelatin | 1.0 |
| Eighth layer: Yellow filter layer (YC) | |
| Yellow colloidal silver | 0.1 |
| Additive (SC-1) | 0.12 |
| High-boiling solvent (Oil-2) | 0.15 |
| Gelatin | 1.0 |
| Ninth layer: Low-speed blue-sensitive emulsion layer (BL) | |
| Silver iodobromide emulsion (Em-1) | 0.25 |
| Silver iodobromide emulsion (Em-2) | 0.25 |
| Sensitizing dye (S-9) | $5.8 \times 10^{-4}$ |
| Yellow coupler (Y-1) | 0.60 |
| Yellow coupler (Y-2) | 0.32 |
| DIR compound (D-2) | 0.01 |
| High-boiling solvent (Oil-2) | 0.18 |
| Gelatin | 1.3 |
| Tenth layer: High-speed blue-sensitive emulsion layer (BH) | |
| Silver iodobromide emulsion (Em-4) | 0.5 |
| Sensitizing dye (S-10) | $3.0 \times 10^{-4}$ |
| Sensitizing dye (S-11) | $1.2 \times 10^{-4}$ |
| Yellow coupler (Y-1) | 0.18 |
| Yellow coupler (Y-2) | 0.10 |
| High-boiling solvent (Oil-2) | 0.05 |
| Gelatin | 1.0 |
| Eleventh layer: First protective layer (PRO-1) | |
| Silver iodobromide emulsion (Em-5) | 0.3 |
| UV absorber (UV-1) | 0.07 |
| UV absorber (UV-2) | 0.1 |
| High-boiling solvent (Oil-1) | 0.07 |
| High-boiling solvent (Oil-3) | 0.07 |
| Gelatin | 0.8 |
| Twelfth layer: Second protective layer (PRO-2) | |
| Alkaline-soluble matting agent (average particle size: 2 μm) | 0.13 |
| Polymethyl methacrylate (average particle size: 3 μm) | 0.02 |
| Gelatin | 0.5 |

Besides the above ingredients, each layer contained a coating aid SU-2 a dispersion aid SU-1, a hardener H-1 and dyes AI-1 and 2.

Each of the emulsions employed consisted of monodispersed grains each having an iodine-rich core.

Em-1: Average silver iodide content: 7.5 mol %, average grain size: 0.55 μm, crystal shape: octahedral Em-2: Average silver iodide content: 2.5 mol %, average grain size: 0.36 μm, crystal shape: octahedral Em-3: Average silver iodide content: 8.0 mol %, average grain size: 0.84 μm, crystal shape: octahedral Em-4: Average silver iodide content: 8.5 mol %, average grain size: 1.02 μm, crystal shape: octahedral Em-5: Average silver iodide content: 2.0 mol %, average grain size: 0.08 μm

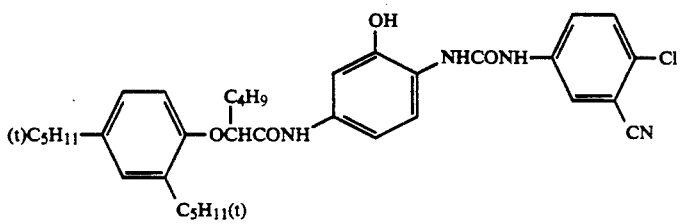

C-1

-continued
C-2
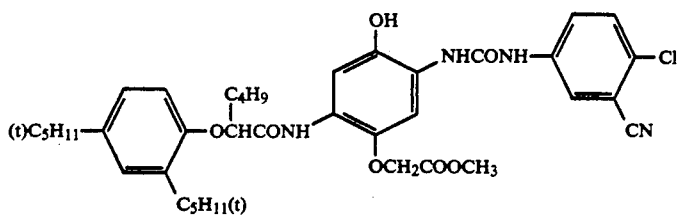
M-A
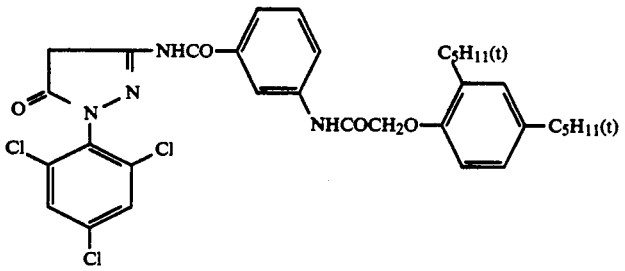
CM-1
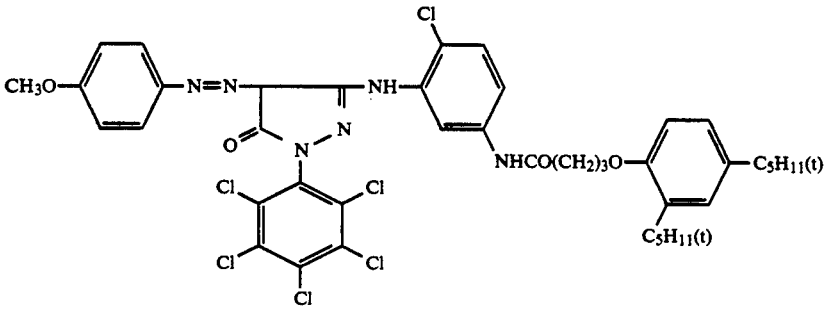
Y-1
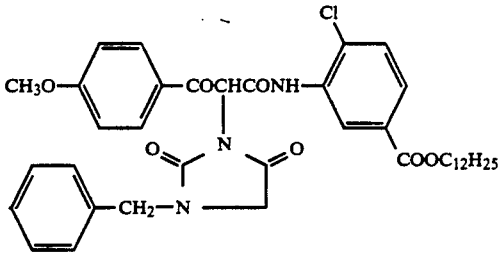
Y-2
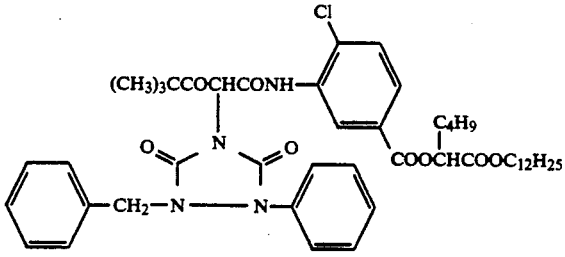
CC-1
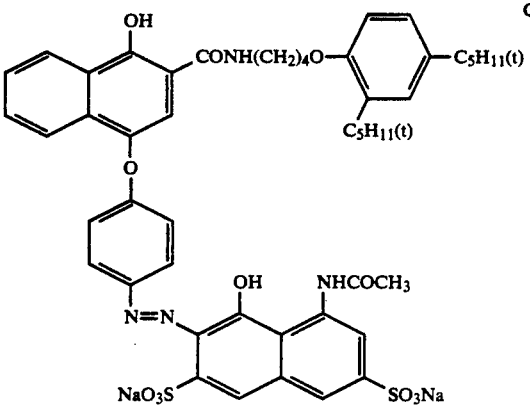
D-1
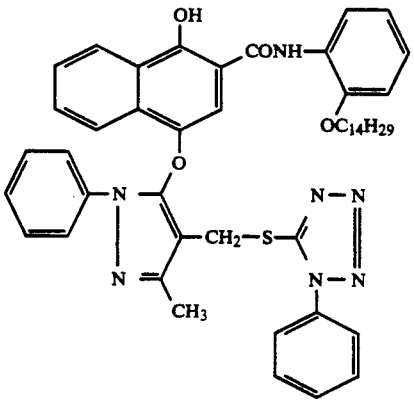

-continued
D-2
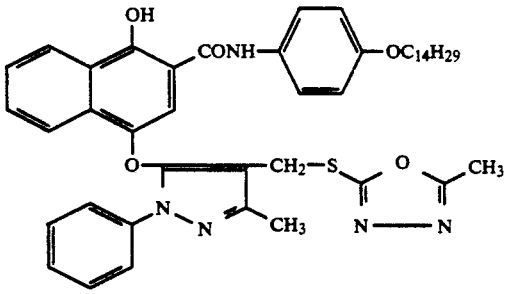
D-3
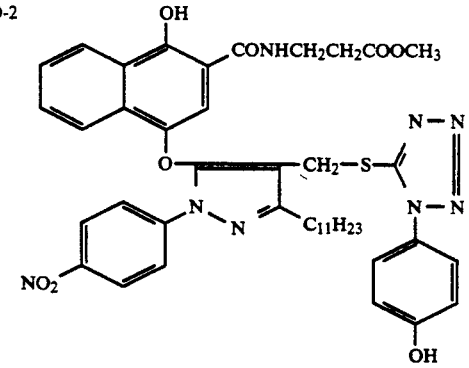
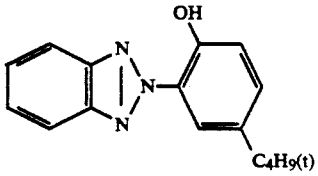
UV-1
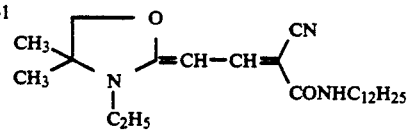
UV-2
S-1
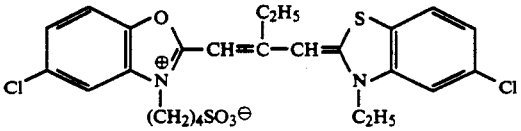
S-2
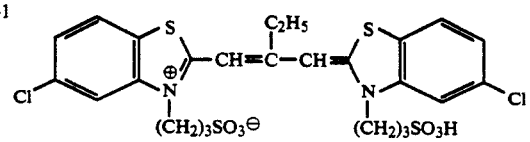
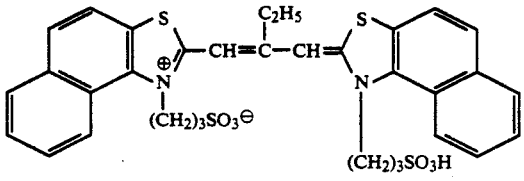
S-3
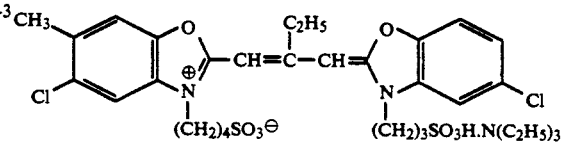
S-4
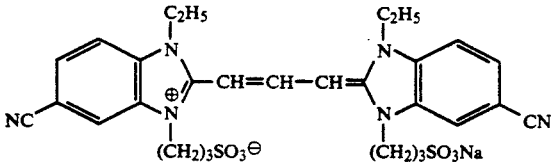
S-5
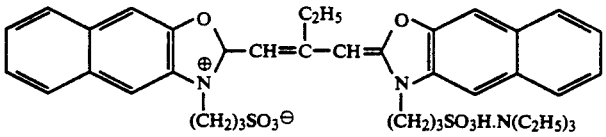
S-6
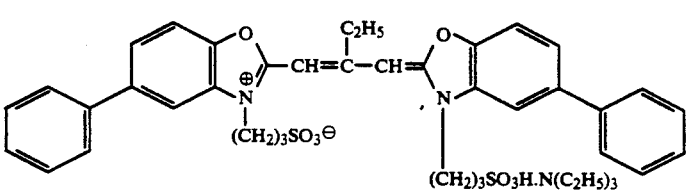
S-7
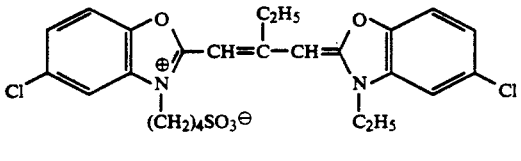
S-8
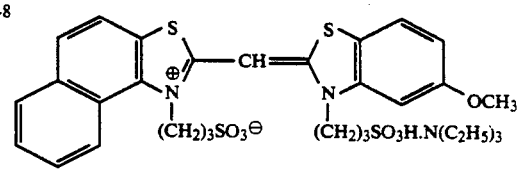
S-9

-continued
S-10
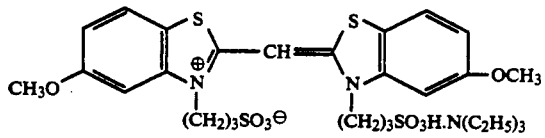
S-11
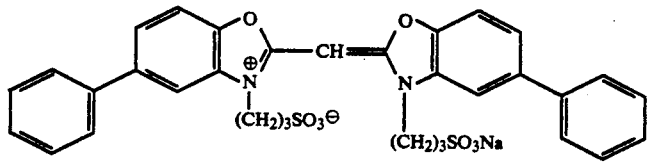
AI-1
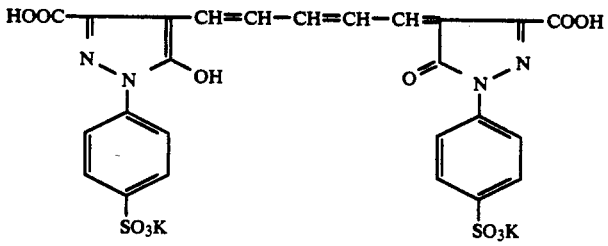
AI-2
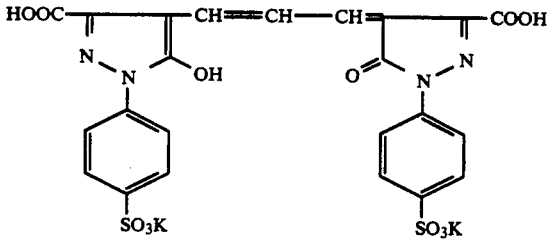
SU-1
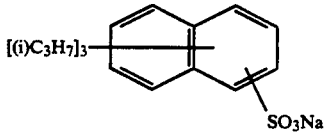
SU-2
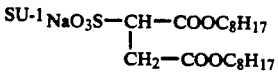
H-1
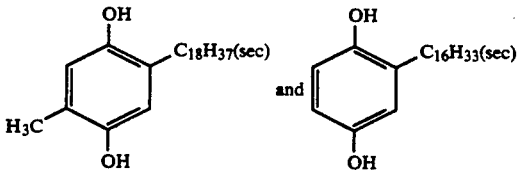
(mixture of 2:3)
SC-1
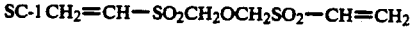
Oil-1
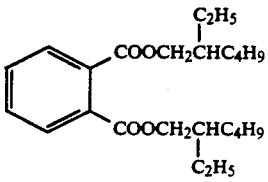
Oil-2
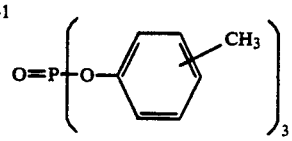

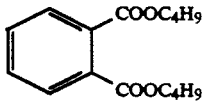

-continued

Oil-3

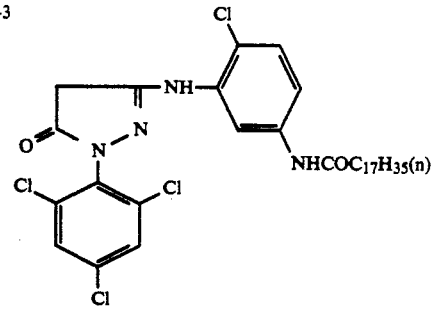

M-B

Sample Nos. 2 and 3 were each prepared in substantially the same manner as in the preparation of Sample No. 1, except that magenta coupler M-A in the 6th and 7th layers was replaced by a magenta coupler shown in Table 1 (the amount was unchanged). Sample Nos. 4 to 20 were each prepared in substantially the same manner as in the preparation of sample No. 1, except that magenta coupler M-A in the 6th and 7th layers was replaced by a magenta coupler shown in Table 1 (the amount was unchanged) and that 0.3 g/m$^2$ of a formalin scavenger shown in Table 1 was added to the 11th layer.

Each of the so-obtained sample Nos. 1 to 20 was subjected to white light through a step wedge (specifically designed for sensitometry), and processed according to the following procedure. After the processing, each sample was examined for the fog and sensitivity of the green-sensitive layer by using green light. Sensitivity was defined as a reciprocal of an amount of light which was needed to obtain a density larger than the fog density by 0.3, and expressed as a value relative to that of sample No. 1 which was set at 100.

| Processing procedure (38° C.) | Processing time |
|---|---|
| Color developing | 3 min. 15 sec. |
| Bleaching | 6 min. 30 sec. |
| Rinsing | 3 min. 15 sec. |
| Fixing | 6 min. 30 sec. |
| Rinsing | 3 min. 15 sec. |
| Stabilizing | 1 min. 30 sec. |
| Drying | |

The compositions of the processing liquids are as follows:

| <Color Developer> | |
|---|---|
| 4-Amino-3-methyl-N-ethyl-N-(β-hydroxyethyl) aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate (monohydrate) | 2.5 g |
| Potassium hydroxide | 1.0 g |

Water was added to make the total quantity 1 l, and pH was adjusted to 10.05.

| <Bleacher> | |
|---|---|
| Ammonium ethylenediaminetetraacetate (III) | 100.0 g |
| Diammonium ethylenediaminetetraacetate | 10.0 g |
| Ammonium bromide | 150.0 g |

-continued

| <Bleacher> | |
|---|---|
| Glacial acetic acid | 10.0 ml |

Water was added to make the total quantity 1 l, and pH was adjusted to 6.0 with aqueous ammonia.

| <Fixer> | |
|---|---|
| Ammonium thiosulfate | 175.0 g |
| Anhydrous sodium sulfite | 8.5 g |
| Sodium metasulfite | 2.3 g |

Water was added to make the total quantity 1 l, and pH was adjusted to 6.0 with acetic acid.

| <Stabilizer> | |
|---|---|
| Water | 900 ml |
| 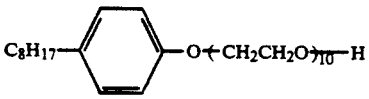 | 2.0 g |
| Dimethylol urea | 0.5 g |
| Hexamethylene tetramine | 0.2 g |
| 1,2-Benzisothiazoline-3-one | 0.1 g |
| Siloxane (L-77 manufactured by UCC) | 0.1 g |
| Aqueous ammonia | 0.5 ml |

Water was added to make the total quantity 1 l, and pH was adjusted to 8.5 with aqueous ammonia or 50% sulfuric acid.

Using each sample, a color checker (manufactured by Macbeth) was photographed. Konica FT-1 MOTOR was employed as a camera. The obtained negatives were subjected to the same treatment as mentioned above.

The resulting positives were each printed on color paper by means of printer A such that the gray part of the color checker would be reproduced to have a reflectance of 18%. As a result, photoprints 1A to 20A were obtained.

Then, printing was performed again in substantially the same manner as mentioned above, except that use was made of printer B which differed from printer A in detecting capacity for the green region. As a result, photoprints IB to 20B were obtained. Photoprints 1A to 20A and photoprints IB to 20B were visually compared to examine whether they differed in hue.

Each of sample Nos. 1 to 20 was subjected to the formalin treatment described below, and was stored in a freezer. These samples were exposed to white light through a step wedge (specifically designed for sensitometry), and then subjected to the same processing as mentioned above. Using green light, the magenta density was measured. The remaining ratio of the maximum magenta density was calculated from the formula given below. The results are shown in Table 1.

Formalin Treatment

The bottom of a container was filled with a liquid that had been prepared by adding 6 ml of 35% formaldehyde to 300 ml of an aqueous glycerin solution. Each sample was put in the container, of which the air had been equilibrated with the liquid, in such a manner that it would not be brought into contact with the liquid. The container was closed tightly, and each sample was kept there at 30° C. for 3 days.

$$\text{Remaining ratio of maximum magenta density} = \frac{\text{Maximum magenta density of a formalin-treated sample}}{\text{Maximum magenta density of a sample stored in a freezer)}} \times 100$$

TABLE 1

| Sample No. | Colored magenta coupler 6th layer | Colored magenta coupler 7th layer | Formalin scavenger | Photographic performance before storage: Fogging | Photographic performance before storage: Sensitivity | Remaining ratio of maximum magenta density (%) | Variation in hue* caused by the change in the type of a printer |
|---|---|---|---|---|---|---|---|
| 1 (Comparative) | M-A | M-A | — | 0.53 | 100 | 44 | A |
| 2 (Comparative) | M-B | M-B | — | 0.54 | 128 | 30 | C |
| 3 (Comparative) | M-5 | M-5 | — | 0.60 | 127 | 36 | B |
| 4 (Comparative) | M-A | M-A | VI-3 | 0.55 | 98 | 96 | A |
| 5 (Comparative) | M-B | M-B | VI-3 | 0.56 | 126 | 94 | C |
| 6 (Inventive) | M-5 | M-5 | VI-3 | 0.56 | 127 | 96 | B |
| 7 (Inventive) | M-7 | M-7 | VI-3 | 0.54 | 129 | 97 | B |
| 8 (Inventive) | M-8 | M-8 | VI-3 | 0.55 | 127 | 97 | B |
| 9 (Inventive) | M-1 | M-1 | VI-3 | 0.54 | 128 | 96 | B |
| 10 (Inventive) | M-17 | M-17 | VI-3 | 0.56 | 129 | 96 | B |
| 11 (Inventive) | M-18 | M-18 | VI-3 | 0.54 | 128 | 97 | B |
| 12 (Inventive) | M-5 | M-5 | VI-28 | 0.54 | 128 | 96 | B |
| 13 (Inventive) | M-5 | M-5 | VI-31 | 0.55 | 127 | 96 | B |
| 14 (Inventive) | M-5 | M-5 | II-5 | 0.55 | 129 | 95 | B |
| 15 (Inventive) | M-5 | M-5 | III-2 | 0.54 | 128 | 95 | B |
| 16 (Inventive) | M-18 | M-5 | VI-3 | 0.56 | 127 | 95 | B |
| 17 (Inventive) | M-18 | M-18 | V-31 | 0.56 | 129 | 95 | B |
| 18 (Inventive) | M-1 | M-1 | V-1 | 0.55 | 127 | 96 | B |
| 19 (Inventive) | M-18 | M-17 | V-31 | 0.54 | 127 | 96 | B |
| 20 (Inventive) | M-3 | M-7 | V-1 | 0.54 | 127 | 97 | B |

*Evaluation by 10 panelists
Very small variation: A
Small variation: B
Considerable variation: C As is evident from the results, sample No. 1 that contained magenta coupler M-A which was outside the scope of the invention was poor in sensitivity and provided a magenta dye of which the density was lowered by the formalin treatment, though it was resistant to fogging and provided photoprints of the same hue irrespective of change in the type of a printer. Sample No. 2 that contained magenta coupler M-B which was outside the scope of the invention was improved in sensitivity and resistance to fogging, but the density of a magenta dye formed therefrom was lowered significantly by the formalin treatment, and photoprints formed therefrom differed greatly in hue depending on the type of printer. Sample No 3 that contained magenta coupler of the present invention was improved in sensitivity and provided photoprints of the same hue irrespective of the type of printer, but was lowered in fogging resistance and the density of the magenta die formed therefrom was lowered significantly by the formalin treatment, Sample No. 4 that contained a formalin scavenger of the invention and magenta coupler M-A provided a magenta dye of which the maximum density was not adversely affected by the formalin treatment, but was poor in sensitivity. Sample No. 5 that contained a formalin scavenger of the invention and magenta coupler M-B was also improved in the resistance of a magenta dye to formalin, but photoprints prepared therefrom differed greatly in hue depending on the type of a printer. Sample Nos. 6 to 20, containing a formalin scavenger of the invention and a magenta coupler of the invention in combination, were each improved in sensitivity and fogging resistance, formed a magenta dye resistant to formalin, and provided photoprints of the same hue irrespective of the type of a printer.

What is claimed is:

1. A silver halide color photographic light sensitive material comprising a support having thereon photographic component layers including a blue-sensitive silver halide emulsion layer, a green-sensitive silver halide emulsion layer and a red-sensitive silver halide emulsion layer, wherein said green-sensitive silver halide emulsion layer contains a magenta coupler represented by Formula M-1 and at least one of said component layers contains a formalin scavenger represented by Formula II through VI;

Formula M-I

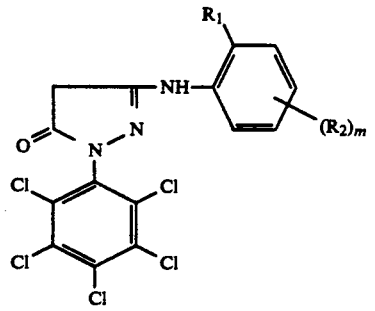

wherein $R_1$ represents a halogen atom or an alkoxy group; $R_2$ represents an acylamino group, a sulfonamido group, an imido group, a carbamoyl group, a sulfamoyl group, an alkoxycarbonyl group, an alkoxycarbonylamino group or an alkoxy group; and m represents an integer of 0 to 4;

Formula II

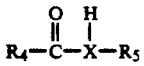

wherein $R_4$ represents a hydrogen atom, an alkyl group, an aryl group, an alkoxy group, an acylamino group or an amino group; $R_5$ represents a hydrogen atom, an alkyl group, an aryl group, an acyl group, an alkoxycarbonyl group, carbamoyl group, an amino group or amidino group; and $R_4$ may combine with $R_5$ to form a ring; and X represents >CH—, or >N—, Formula III

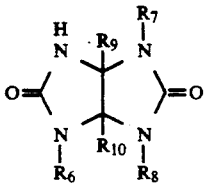

wherein $R_6$, $R_7$ and $R_8$ each represent a hydrogen atom, an alkyl group, an alkenyl group, an aralkyl group, an aryl group or an acyl group; and $R_9$ and $R_{10}$ each represent a hydrogen atom or an alkyl group, Formula IV

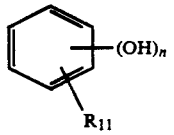

wherein $R_{11}$ represents a hydrogen atom, an alkyl group or an aryl group, provided, $R_{11}$ may form a naphthalene ring together with a phenyl ring; and n represents an integer of 2 or more, Formula V

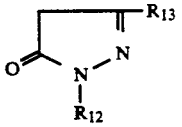

wherein $R_{12}$ represents a hydrogen atom or a substituent; and $R_{13}$ represents a hydrogen atom or a substituent, Formula VI

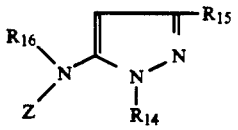

wherein $R_{14}$ and $R_{15}$ each represent a hydrogen atom or a substituent; $R_{16}$ represents a hydrogen atom or an alkyl group; Z represents a hydrogen atom, an aryl group, $—SO_2R_{17}$ or

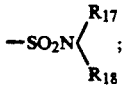

provided, $R_{16}$ and Z may combine together to form a ring; $R_{17}$ represents an alkyl group, an aryl group or a heterocyclic group; and $R_{18}$ has the same meaning as $R_{16}$.

2. A color photographic material of claim 1 wherein said magenta coupler is contained in an amount of $1\times10^{-1}$ to 1 mol per mol of silver halide.

3. A color photographic material of claim 2 wherein said magenta coupler is contained in an amount of $1\times10^{-2}$ to $8\times10^{-1}$ mol per mol of silver halide.

4. A color photographic material of claim 1 wherein in Formula [M-I], $R_1$ is a chlorine atom, $R_2$ is an acylamino group located at the para-position with respect to $R_1$, and m is 1.

5. A color photographic material of claim 1, wherein said formalin scavenger is contained in the magenta coupler-containing layer or in one of the component layers provided farther from the support than the magenta coupler-containing layer.

6. A color photographic material of claim 5 wherein said formalin scavenger is contained in a protective layer.

7. A color photographic material of claim 5 wherein said formalin scavenger is contained in an amount of 0.01 to 5.0 g per square meter of the color photographic material.

8. A color photographic material of claim 7 wherein said formalin scavenger is contained in an amount of 0.1 to 2.0 g per square meter of the color photographic material.

9. A color photographic material of claim 1 wherein said formalin scavenger is represented by Formula III through VI as claimed.

10. A color photographic material of claim 9 wherein in Formula VI, $R_{14}$ is a sulfophenyl group, $R_{15}$ is an alkyl group, $R_{16}$ and Z each are a hydrogen atom.

* * * * *

UNITED STATES PATENT AND TRADEMARK OFFICE

CERTIFICATE OF CORRECTION

PATENT NO. : 5,275,926

DATED : January 04, 1994

INVENTOR(S) : Shigeto Hirabayashi et al.

It is certified that error appears in the above-indentified patent and that said Letters Patent is hereby corrected as shown below:

Claim 2, column 38, line 24, change "$1x10^{-1}$" to --$1x10^{-3}$--.

Claim 4, column 38, line 29, change [M-I] to --M-I--.

Signed and Sealed this

Eighteenth Day of October, 1994

*Attest:*

*Attesting Officer*

BRUCE LEHMAN

*Commissioner of Patents and Trademarks*